US008347957B2

(12) United States Patent
Stephenson et al.

(10) Patent No.: US 8,347,957 B2
(45) Date of Patent: Jan. 8, 2013

(54) SYSTEM AND METHOD FOR SERVICING A WELLBORE

(75) Inventors: Stanley V. Stephenson, Duncan, OK (US); Ronald Edward Dant, Duncan, OK (US); Herb John Horinek, Duncan, OK (US); Max Lynn Phillippi, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 688 days.

(21) Appl. No.: 12/502,904

(22) Filed: Jul. 14, 2009

(65) Prior Publication Data

US 2011/0011581 A1 Jan. 20, 2011

(51) Int. Cl.
*E21B 47/00* (2012.01)

(52) U.S. Cl. ..... 166/250.01; 166/66; 702/184; 417/53

(58) Field of Classification Search ..... 166/250.01, 166/105, 65.1, 66; 702/184; 417/1, 53
See application file for complete search history.

(56) References Cited

U.S. PATENT DOCUMENTS

| | | | | |
|---|---|---|---|---|
| 5,608,845 | A * | 3/1997 | Ohtsuka et al. | 706/45 |
| 5,846,056 | A * | 12/1998 | Dhindsa et al. | 417/44.2 |
| 6,401,056 | B1 * | 6/2002 | Sirois | 702/184 |
| 6,704,689 | B1 * | 3/2004 | Hogan et al. | 702/184 |
| 6,742,441 | B1 | 6/2004 | Surjaatmadja et al. | |
| 6,859,740 | B2 | 2/2005 | Stephenson et al. | |
| 7,431,569 | B2 * | 10/2008 | Griffiths | 417/53 |
| 7,801,707 | B2 * | 9/2010 | Bailey et al. | 703/2 |
| 2003/0009311 | A1 * | 1/2003 | Ushiku et al. | 702/184 |
| 2006/0088425 | A1 | 4/2006 | Lucas et al. | |
| 2008/0262736 | A1 * | 10/2008 | Thigpen et al. | 702/9 |
| 2009/0041588 | A1 | 2/2009 | Hunter et al. | |
| 2011/0005771 | A1 * | 1/2011 | Watson et al. | 166/369 |
| 2011/0172833 | A1 * | 7/2011 | Vail | 700/282 |
| 2011/0255992 | A1 * | 10/2011 | Tran et al. | 417/1 |
| 2012/0016589 | A1 * | 1/2012 | Li et al. | 702/9 |

OTHER PUBLICATIONS

Stephenson, Stan, "Weibull analysis of failures with different stress histories," Applied Reliability Symposium, Orlando, Florida, 2006, pp. 1-26, Halliburton.

* cited by examiner

*Primary Examiner* — Daniel P Stephenson
(74) *Attorney, Agent, or Firm* — John W. Wustenberg; Conley Rose, P.C.

(57) ABSTRACT

A method of servicing a wellbore, comprising establishing a pumping profile having a performance plan, determining a remaining life estimate for a first wellbore servicing device, wherein the first wellbore servicing device is suitable for impacting conformance to the performance plan, and selecting a second wellbore servicing device in response to the remaining life value for the first wellbore servicing device, wherein the second wellbore servicing device is suitable for impacting conformance to the performance plan. A wellbore servicing system, comprising a first device suitable for impacting conformance to a performance plan, a first sensor configured to monitor an operational characteristic of the first device, and a controller in communication with the first sensor, the controller being configured to calculate at least one of a remaining life estimate of the first device and a probability of survival estimate of the first device.

25 Claims, 6 Drawing Sheets

SYSTEM AND METHOD FOR SERVICING A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

Embodiments described herein relate to wellbore servicing equipment and methods of servicing a wellbore.

BACKGROUND

Wellbore servicing equipment failures may occur during performance of a wellbore servicing operation. Such equipment failures may result in a variety of problems including, among other things, causing inconvenient time delays in performing the wellbore servicing operation, unexpected and/or undesirable timing and expense of equipment repairs, and/or damage to the wellbore and the associated subterranean formation being treated in the wellbore servicing operation. Further, since the wellbore servicing equipment may fail while being used for a wellbore servicing operation, it is not uncommon to mobilize more equipment than needed for the treatment to ensure sufficient equipment is available if there are any wellbore servicing equipment failures during the treatment. In some cases, all mobilized pumping equipment may be used at relatively lower loads, but if some pumping equipment fails, the loads on at least some of the remaining pumping equipment may be increased. In other cases, some of the pumping equipment may be left offline until needed due to a failure of other pumping equipment. While mobilizing additional wellbore servicing equipment to a particular wellbore servicing operation may provide relief when some equipment fails, current systems and methods of selecting equipment may lead to provisioning too little or too much equipment for a wellbore servicing operation. Providing too much or too little for a wellbore servicing operation may result in increased cost of the wellbore servicing operation and/or a misappropriation of equipment such that the additional equipment is not well utilized. Accordingly, there exists a need for systems and methods that provide for better selection of wellbore servicing equipment for use in wellbore servicing operations.

SUMMARY

Disclosed herein is a method of servicing a wellbore, comprising establishing a pumping profile having a performance plan, determining a remaining life estimate for a first wellbore servicing device, wherein the first wellbore servicing device is suitable for impacting conformance to the performance plan, and selecting a second wellbore servicing device in response to the remaining life value for the first wellbore servicing device, wherein the second wellbore servicing device is suitable for impacting conformance to the performance plan.

Also disclosed herein is a wellbore servicing system, comprising a first device suitable for impacting conformance to a performance plan, a first sensor configured to monitor an operational characteristic of the first device, and a controller in communication with the first sensor, the controller being configured to calculate at least one of a remaining life estimate of the first device and a probability of survival estimate of the first device.

Further disclosed herein is a wellbore servicing pump, comprising a first sensor configured to monitor an operational characteristic of the pump, and a controller in communication with the first sensor, the controller being configured to calculate at least one of a remaining life estimate of the wellbore servicing pump and a probability of survival estimate of the wellbore servicing pump.

BRIEF DESCRIPTION OF THE DRAWINGS

For a more complete understanding of the present disclosure, and for further details and advantages thereof, reference is now made to the accompanying drawings, wherein.

DETAILED DESCRIPTION OF THE EMBODIMENT(S)

Figure 1:
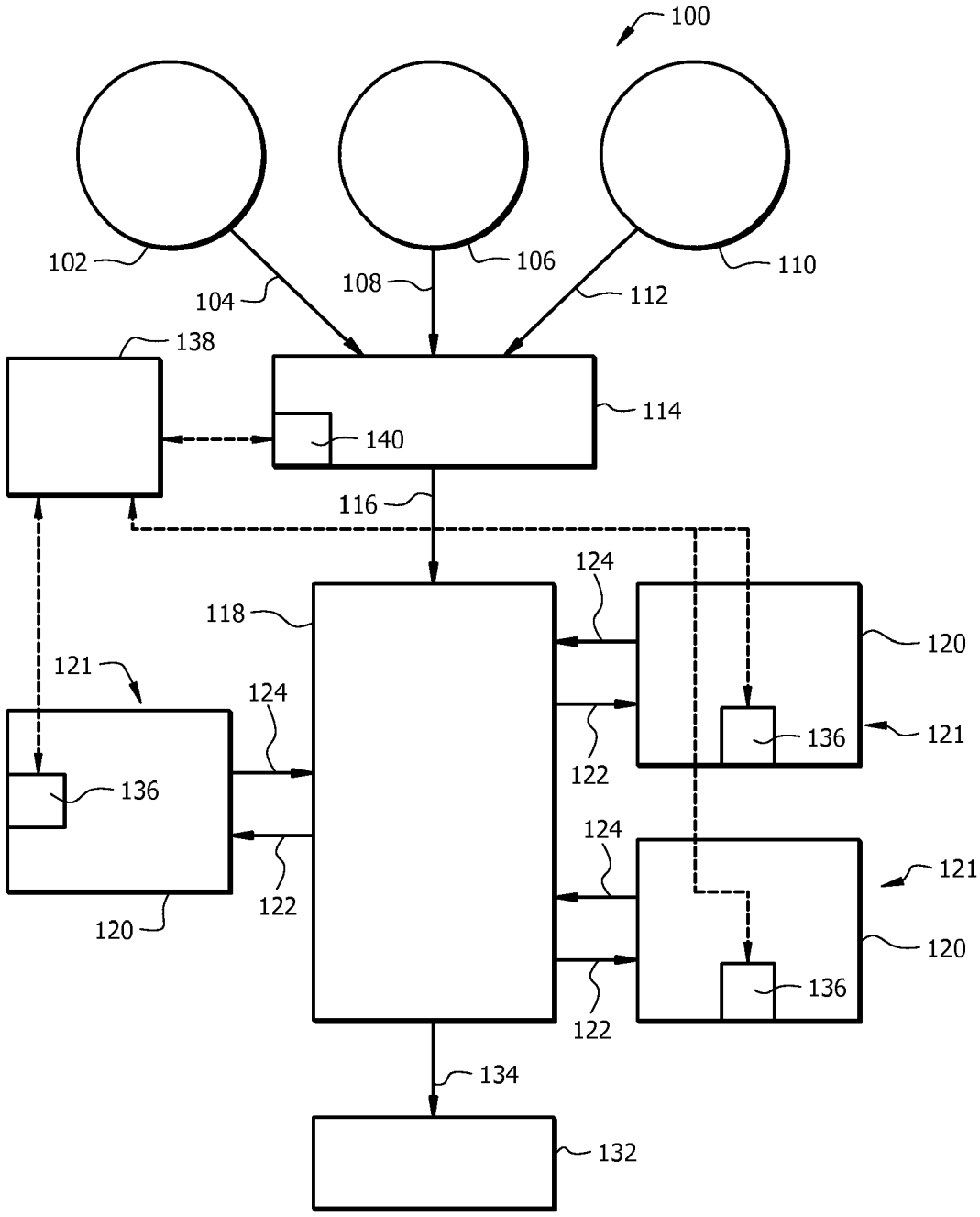
FIG. 1 is a simplified schematic view of a wellbore servicing system according to an embodiment.

Selection of wellbore servicing equipment for a wellbore servicing operation may be an important component of achieving successful and profitable results in the wellbore servicing industry. In particular, selection of the proper amount and/or number of a particular type of wellbore servicing equipment may be important to enable conformance to a required performance during a wellbore servicing operation. Hereinafter, the process of selecting wellbore servicing equipment for use in a wellbore servicing operation may be referred to as "equipment casting."

Further, once one or more pieces of equipment have been cast for a wellbore servicing operation, it will be appreciated that field conditions may dictate that what may have initially been a prudent equipment casting is no longer suitable, thereby requiring more and/or different pieces equipment. For purposes of this discussion, the process of reevaluating the equipment needs of a wellbore servicing operation due to field conditions or other post-equipment casting considerations may be referred to as "equipment recasting" and/or "management of field equipment." Generally, the present disclosure provides systems and methods for improved equipment casting and recasting by considering a "remaining life" estimate of the specific pieces of equipment considered in the casting and recasting processes and/or by considering a "probability of survival" estimate of the specific pieces of equipment considered in the casting and recasting processes. The present disclosure also provides systems and methods for displaying and/or communicating a remaining life estimate and/or probability of survival estimate for a piece of wellbore servicing equipment.

The "remaining life" estimate and the "probability of survival" estimate referred to above are terms that are closely tied to results achievable through the methods most clearly explained in the presentation materials titled "Weibull Analysis of Failures with Different Stress Histories" which was authored by Mr. Stan Stephenson and presented in 2006 at an Applied Reliability Symposium held in Orlando, Fla. The "Weibull Analysis of Failures with Different Stress Histories" presentation material (hereinafter referred to as the "presentation materials") is hereby incorporated by reference in its entirety and may be referred to specifically by the presentation slide number when helpful to aid understanding of the present disclosure.

In a first methodology primarily discussed in slides 5-11 of the presentation materials, a remaining life estimate and probability of survival estimate are derived for a ball bearing. In this first methodology, a concept of "equivalency" is shown to mean that a first amount of exposure of the ball bearing to a first stress level can be equated to a reference level of exposure of the ball bearing to a reference stress level. The presentation materials further explain how a Miner's Rule summation of equivalent exposures to a reference exposure at a reference stress level can yield a percent of life used value (see slides 9-10). It will be appreciated that in other embodiments, other life equations may be used. Of course, where a percent of life used value is calculated, it can be shown that a remaining life estimate may be calculated generally by subtracting the percent of life used value from one hundred percent. Further, it will be appreciated that a summation of equivalent exposures at a reference stress level may be used in a Weibull or other statistical distribution analysis to produce a probability of survival estimate. While the example and derivations at slides 5-11 are suitable for evaluating equipment and/or components with single stress variables and/or when substantially similar stress histories are used to create a Weibull or other statistical distribution, more complex methodologies are required to yield similar results for equipment and/or components with multiple stress variables and/or for when different stress histories are used to create a Weibull or other statistical distribution.

More specifically, slides 21-46 demonstrate the methodology necessary to derive equations for determining a remaining life estimate and probability of survival estimate for a valve of a high pressure positive displacement pump for use in wellbore servicing operations. At slide 24, the presentation materials explain that pump discharge pressure (P) and pump flowrate (Q) are the stress variables included in the derivation of the equations. Specifically, at slide 39 an "equivalency" equation is provided that allows an equivalent total volume to be calculated as a function of an actual total volume, an actual pressure, an actual flowrate, a reference pressure, and a reference flowrate. By converting data representing actual volumes pumped at actual pressures and actual flowrates to equivalent volumes pumped at reference pressures and reference flowrates, a remaining life estimate can be determined using Miner's Rule or other life equations. Similarly, using the equivalent volume values, a Weibull or other statistical analysis can be applied to yield a probability of survival estimate for a valve.

It will be appreciated that each of the above methods of deriving equations for determining a remaining life estimate and probability of survival estimate are described in the presentation materials sufficiently generically so that equations for substantially any component of any piece of wellbore servicing equipment can be similarly evaluated. Specifically, the same methodology can be used for crankshafts, connecting rods of pumps, and/or any other component. However, it will further be appreciated that the above described derived equations and methodologies must be accompanied and/or otherwise supplemented by sufficient "conventional failure information" (such as the standardized B10 life of a bearing discussed at slide 8) and/or "failure data sets" that provide sufficient historical tracking of the operation of the component over the entire life of the component until the component failed. Where data that tracks the use of a component to failure is to be provided for use in determining a remaining life estimate and/or probability of survival estimate, the data should include actual values of all of the stress variables being considered (e.g., the actual volume pumped, the actual pressure, and the actual flowrate of the valve of the discussion at slides 21-46). It will further be appreciated that while the failure data sets may be true historical data of actual equipment being operated, the failure data sets may alternatively comprise computer generated failure data that corresponds to computer modeled wellbore servicing equipment and/or components (see slide 17-20). Alternatively, the failure data sets may comprise a combination of actual and simulated failure data.

Figure 6:
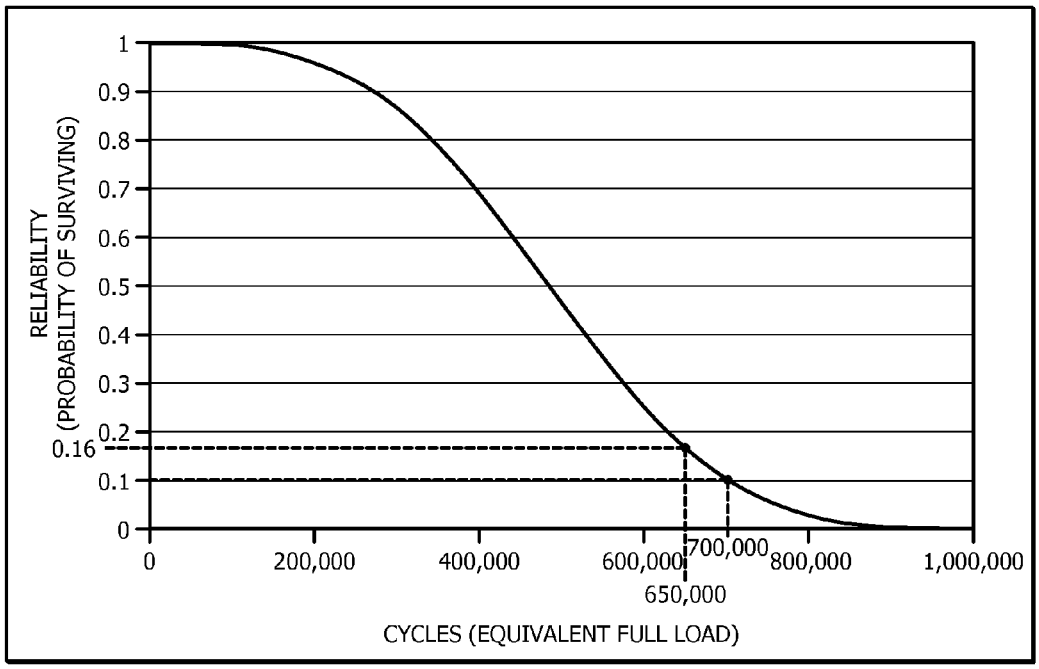
FIG. 6 is an example of a plot showing a curve used to determine probability of survival estimates.

It will further be appreciated that performing either of the two above-described methods (e.g., actual and/or simulated failure data) of deriving equations for and determining a remaining life estimate and probability of survival estimate for a wellbore servicing device or a component thereof both require several common steps. The steps generally comprise, constructing "failure data sets" (e.g., comprising actual and/or simulated failure data), deriving an equivalency equation (e.g., based on Miner's Rule or other life equations and failure data sets representing the appropriate stress variables), converting actual exposure values as a function of actual stress variable values to equivalent exposure values as a function of the applicable reference stress variable values, constructing a statistical distribution (e.g., according to a Weibull or other statistical analysis) based on the failure data sets adjusted to equivalent conditions, monitoring and recording actual exposure and/or stress variable values for later conversion to equivalent exposures, and determining the amount of life expended based on a function of the equivalent exposures. After calculating the amount of life expended, the amount of remaining life can be calculated and from the Weibull or other statistical distribution, the probability of survival to those equivalent conditions can be determined. Once the equivalency equations and Weibull or other statistical distribution is developed, anticipated future usage on a particular job can be entered to determine the probability the components will survive the anticipated usage. Conditional probability calculations are used to determine the probability of surviving future conditions based off the Weibull or other statistical distribution developed. FIG. 6 shows how the conditional probability works. For instance, a device has a about a 16% chance of surviving to 650,000 equivalent cycles and about a 10% probability of surviving to 700,000 equivalent cycles. However, if the device has already survived to 650,000 cycles, it has about a 60% probability (e.g., the difference of the higher 16% probability and the lower 10% probability) it will survive an additional 50,000 equivalent cycles to 700,000 equivalent cycles. Further, as explained below, the conditional probability of survival of all pumps of a pump group, for instance, can be combined to determine the total probability of completing the job as designed.

Generally, the above described steps of calculating a remaining life estimate and/or a probability of survival estimate for particular pieces of equipment provide a more intelligent manner of selecting wellbore servicing equipment. For example, equipment casting can be accomplished so that all pieces of equipment of a particular type (e.g., positive displacement pumps as discussed below) statistically collectively provide at least a selected required probability of survival estimate for the group of equipment. Similarly, equipment casting can be accomplished so that no piece of equipment has below a selected required probability of survival estimate.

In much the same way, equipment casting can be accomplished so that all pieces of equipment of particular type collectively provide at least a minimum probability of completing a desired wellbore treatment. Similarly, equipment casting can be accomplished so that no piece of equipment has below a selected required probability of completing a desired wellbore treatment. It will be appreciated that equipment casting and/or recasting according to the above may provide improved management of wellbore servicing equipment and increased wellbore servicing operation success rates by predicting and avoiding equipment failures and/or preventing providing too little or too much equipment in view of the condition of the equipment. Further, the present disclosure may prevent dependence on equipment that may be predictably due for maintenance before completion of a wellbore servicing operation.

For any type of wellbore servicing equipment, once a model is developed to yield the amount of life expended, the model may be used to calculate a true cost of operating the equipment on a particular wellbore service job or treatment. For example, instead of averaging the maintenance costs of a piece of equipment across various wellbore service jobs to determine a maintenance cost attributable to a particular wellbore servicing job, the calculated percent of life of a piece of equipment may be used to calculate a prorated amount of the future repairs of the equipment to the particular job. Accordingly, pricing of the wellbore treatments may be adjusted to more closely reflect the true cost of wear and tear and/or resultant anticipated maintenance necessitated by the treatment in a manner that does not rely on simply averaging maintenance costs over a plurality of jobs that contribute differently to the expenses incurred or anticipated.

Similarly, the above described ability to calculate the amount of life of a piece of equipment that has been expended allows for more effective planning of spare parts requirements. As market changes occur that result in changes to wellbore treatments, the characteristics of the anticipated new jobs may be used in the above model to determine the anticipated number of components/systems/parts to be consumed and the number of components/systems/parts required to meet the need of the new and/or changed market. As a result, the required spare parts may be anticipated to proactively maximize equipment and/or part availability.

Still further, the above-enabled ability to calculate true life consumption of a piece of equipment allows accurate measurement of improvements when design changes are made to equipment components and/or systems. With the methods disclosed herein, the common equivalent conditions may be used to accurately determine improvements attributable to those design changes even when the equipment is operated according to different and/or multiple operating/stress profiles (e.g., a variety of different wellbore servicing treatment jobs that stress or cause wear and tear on equipment differently).

Referring to FIG. 1, a wellbore servicing system 100 is shown. The wellbore servicing system 100 is configured for fracturing wells in low-permeability reservoirs, among other wellbore servicing jobs. In fracturing operations, wellbore servicing fluids, such as particle laden fluids, are pumped at high pressure downhole into a wellbore. In this embodiment, the wellbore servicing system 100 introduces particle laden fluids into a portion of a subterranean hydrocarbon formation at a sufficient pressure and velocity to cut a casing, create perforation tunnels, and/or form and extend fractures within the subterranean hydrocarbon formation. Proppants, such as grains of sand, are mixed with the wellbore servicing fluid to keep the fractures open so that hydrocarbons may be produced from the subterranean hydrocarbon formation and flow into the wellbore. This hydraulic fracturing creates high-conductivity fluid communication between the wellbore and the subterranean hydrocarbon formation.

The wellbore servicing system 100 comprises a blender 114 that is coupled to a wellbore services manifold trailer 118 via a flowline 116. As used herein, the term "wellbore services manifold trailer" is meant to collectively comprise a truck and/or trailer comprising one or more manifolds for receiving, organizing, and/or distributing wellbore servicing fluids during wellbore servicing operations. In this embodiment, the wellbore services manifold trailer 118 is coupled to three positive displacement pumps 120 via outlet flowlines 122 and inlet flowlines 124. Outlet flowlines 122 supply fluid to the pumps 120 from the wellbore services manifold trailer 118. Inlet flowlines 124 supply fluid to the wellbore services manifold trailer 118 from the pumps 120. Together, the three positive displacement pumps 120 form a pump group 121. In alternative embodiments, however, there may be more or fewer positive displacement pumps used in a wellbore servicing operation and/or the pumps may be other than positive displacement pumps. The wellbore services manifold trailer 118 generally has manifold outlets from which wellbore servicing fluids flow to a wellhead 132 via one or more flowlines 134. Each pump 120 is further equipped with a pump monitor 136 that monitors various operational characteristics of the pumps 120 to which the pump monitors 136 are associated. More specifically, the pump monitors 136 comprise any sensors necessary to monitor, record, report, communicate, display, and/or log the various operational characteristics of the pumps 120 as described below in more detail.

Figure 2:
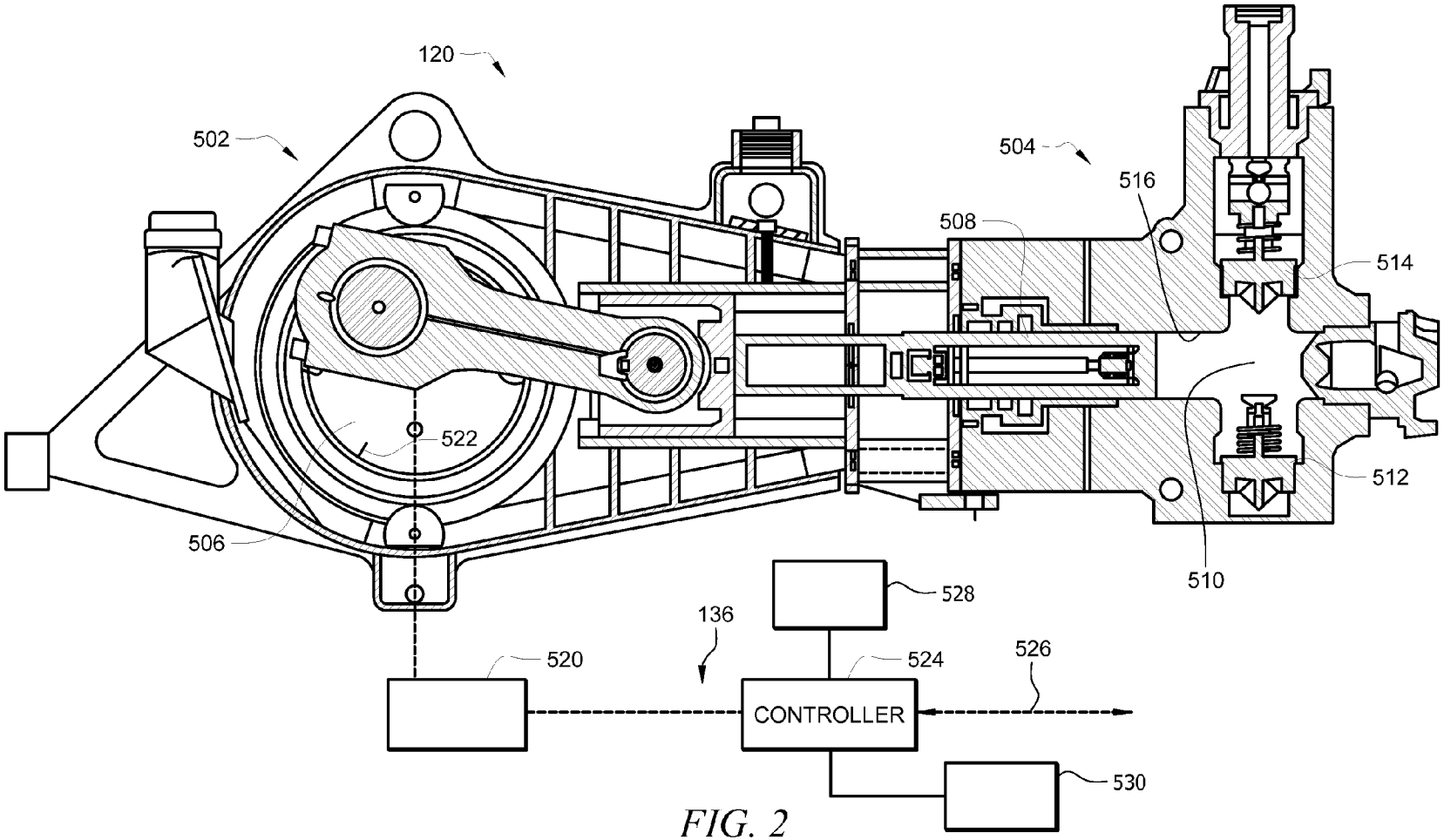
FIG. 2 is a cut-away view of a pump according to the system of FIG. 1.

Referring now to FIG. 2, a pump 120 is shown in greater detail. In this embodiment, the pumps 120 are HT-400™ Triplex positive displacement pumps, produced by Halliburton Energy Services, Inc. Pump 120 comprises a power end 502 and a fluid end 504 attached to the power end 502. The power end 502 comprises a crankshaft 506 that reciprocates a plunger 508 within a bore 516 of the fluid end 504. The fluid end 504 further comprises a compression chamber 510 into which fluid flows through a suction valve 512. Fluid is pumped out of the compression chamber 510 through a discharge valve 514 as the plunger 508 is moved toward the compression chamber 510. A sensor 520 of the pump monitor 136 uses a timing marker 522 that is associated with the crankshaft 506 to monitor the number of rotations of the crankshaft 506. The pump monitor 136 further comprises a multi-purpose sensor 528 for sensing the necessary operational characteristics of the pump 120 and/or wellbore treating fluid, including output pressure, hours at pressure bands (explained in greater detail below), hours at power bands (explained in greater detail below), horsepower hours, hours of pump operation per drive gear, and combinations thereof. A controller 524 receives signals from the sensors 520, 528 and is configured to monitor, record, report, communicate, display, and/or log the information provided to the controller 524 by the sensors 520, 528. Of course, the controller 524 may be connected to other systems, computers, monitors, controllers, and/or other suitable equipment for monitoring the pump 120.

It will further be appreciated that communication between the controller 524 and other systems may be bi-directional and may take place over a bi-directional communications link 526. Of course, in alternative embodiments, the pump monitor 136 may be self-contained, may communicate in a unidirectional manner, and may comprise other systems or components for monitoring, recording, reporting, communicating, displaying, and/or logging the information provided to the controller 524 by the sensors 520, 528. In this embodiment, a display 530 is in communication with the controller 524 and may selectively display any of the above monitored operational characteristics of the pump 120 and/or a remaining life estimate and/or a probability of survival estimate of the pump 120.

The blender 114 mixes solid and fluid components to achieve a well-blended wellbore servicing fluid. As depicted, sand or proppant 102, water 106, and additives 110 are fed into the blender 114 via feedlines 104, 108, and 112, respectively. The fluid 106 may be potable water, non-potable water, untreated water, treated water, hydrocarbon based or other fluids. The mixing conditions of the blender 114, including time period, agitation method, pressure, and temperature of the blender 114, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering the wellbore services manifold trailer 118. A blender monitor 140 monitors various operational characteristics of the blender 114 in substantially the same manner pump monitor 136 monitors operation characteristics of the pump 120. It will be appreciated that the pump monitors 136 and the blender monitor 140 provide information to a master controller 138 that is in communication with the pump monitors 136 and a blender monitor 140. The blender monitor 140 is also capable of selectively displaying any monitored operational characteristic of the blender 114 and/or a remaining life estimate and/or a probability of survival estimate of the blender 114.

Figure 3:
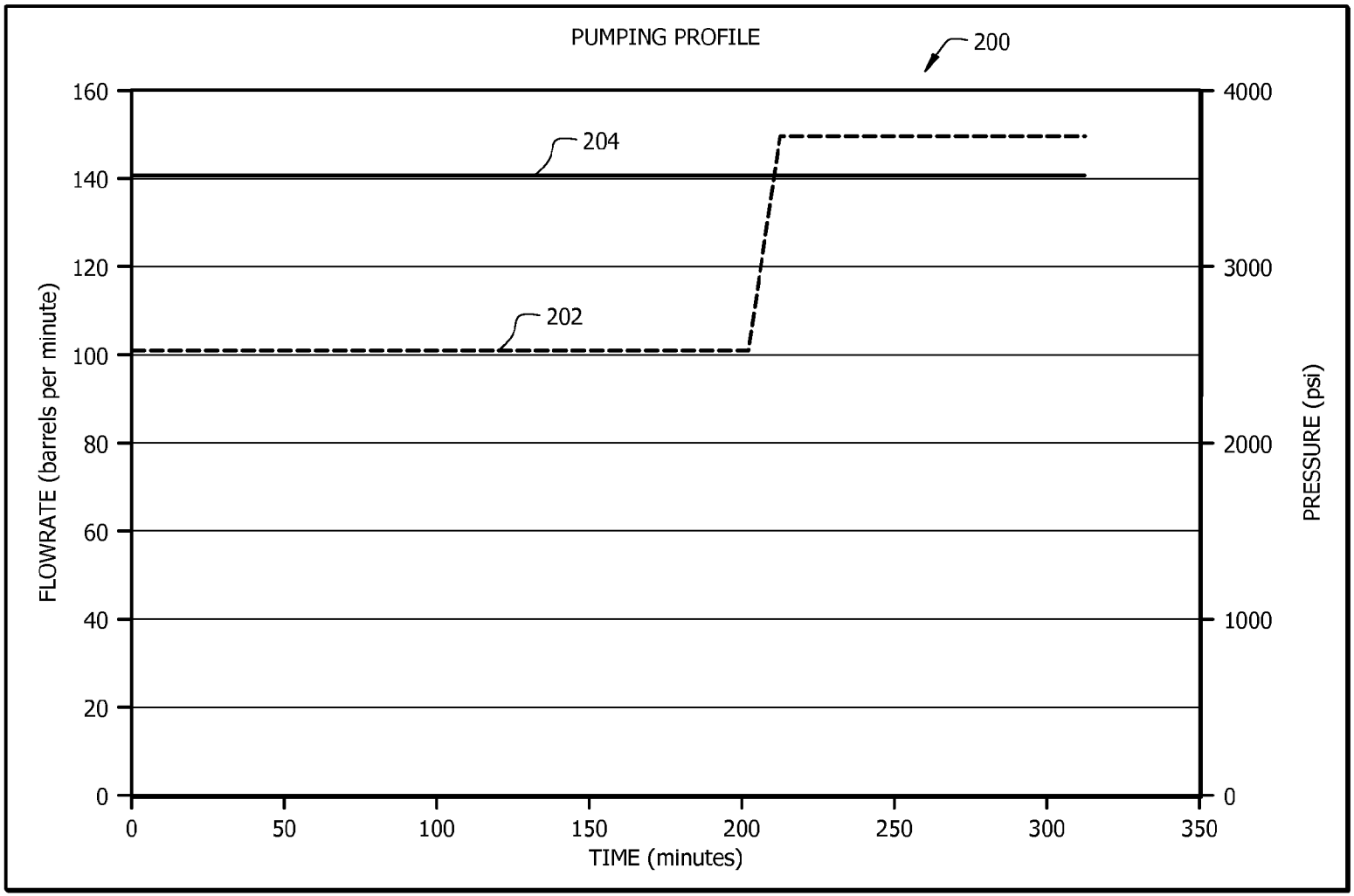
FIG. 3 is a graph of a performance plan according to a pumping profile of the wellbore servicing system of FIG. 1.

Referring now to FIG. 3, the wellbore servicing system 100 is operable to deliver wellbore servicing fluids to the wellhead 132 according to an established pumping profile 200. A pumping profile is defined herein as comprising a performance plan for an operational characteristic of a wellbore servicing system. It will be appreciated that a single pumping profile may comprise one or more performance plans and that a wellbore servicing system may operate according to one or more pumping profiles, either simultaneously or consecutively. It will further be appreciated that a single pumping profile may comprise one or more performance plans for a single operational characteristic. In other words, a pumping profile may comprise one or more performance plans for one or more operational characteristics of a wellbore servicing system and a wellbore servicing system may operate according to one or more pumping profiles.

Still referring to FIG. 3, pumping profile 200 comprises a performance plan for a combined pump group flowrate of the pump group 121 over a period of time. More specifically, the pumping profile 200 is represented as a graph of a desired flowrate delivered downhole in barrels per minute of the pump group 121. The plot of the desired flowrate is performance plan 202. As shown, pump group 121 is tasked with delivering wellbore servicing fluids downhole at a rate of about 100 barrels per minute for about the first 200 minutes of operation. After the first 200 minutes of operation, the flowrate of fluid delivery downhole is increased over approximately 10 minutes to a new desired combined flowrate of approximately 150 barrels per minute. After reaching the flowrate of approximately 150 barrels per minute, the pump group 121 is tasked with continuing to deliver about 150 barrels per minute until about minute 320 of operation. Pumping profile 200 further comprises a performance plan 204 for a combined pump group pressure, the pressure at which fluids are delivered downhole by pump group 121. In this embodiment, and according to pumping profile 200, the pump group 121 is tasked with delivering wellbore servicing fluids downhole at a pressure of about 3500 psi over the entire about 320 minutes of operation. It will be appreciated that in other embodiments and in this embodiment when operated according to alternative pumping profiles, pump group 121 may be tasked with delivering wellbore servicing fluids downhole at various other pressures over the course of operation of the pump group 121. Pumping profile 200 is an example of a pumping profile that comprises a plurality of performance plans since pumping profile 200 comprises both the performance plan 202 for a combined pump group flowrate and the performance plan 204 for the combined pump group pressure.

It will be appreciated that any of the master controller 138, the pump monitors 136, and the blender monitor 140 are configured to receive data representative of the pumping profile 200 for the purpose of enabling the master controller 138, the pump monitors 136, and the blender monitor 140 to calculate and display a remaining life estimate and/or a probability of survival estimate. More specifically, the master controller 138, which may be located significantly remotely from the wellbore 134 location, is configured to selectively calculate a remaining life estimate and/or a probability of survival estimate for any of the pumps 120 and/or for the blender 114. The pump monitor 136 is selectively capable of calculating and displaying a remaining life estimate and/or a probability of survival estimate for the pump 120 to which the pump monitor 136 is attached. Similarly, the blender monitor 140 is selectively capable of calculating and displaying a remaining life estimate and/or a probability of survival estimate for the blender 114 to which the blender monitor 140 is attached.

EXAMPLES

Example 1

Figure 4:
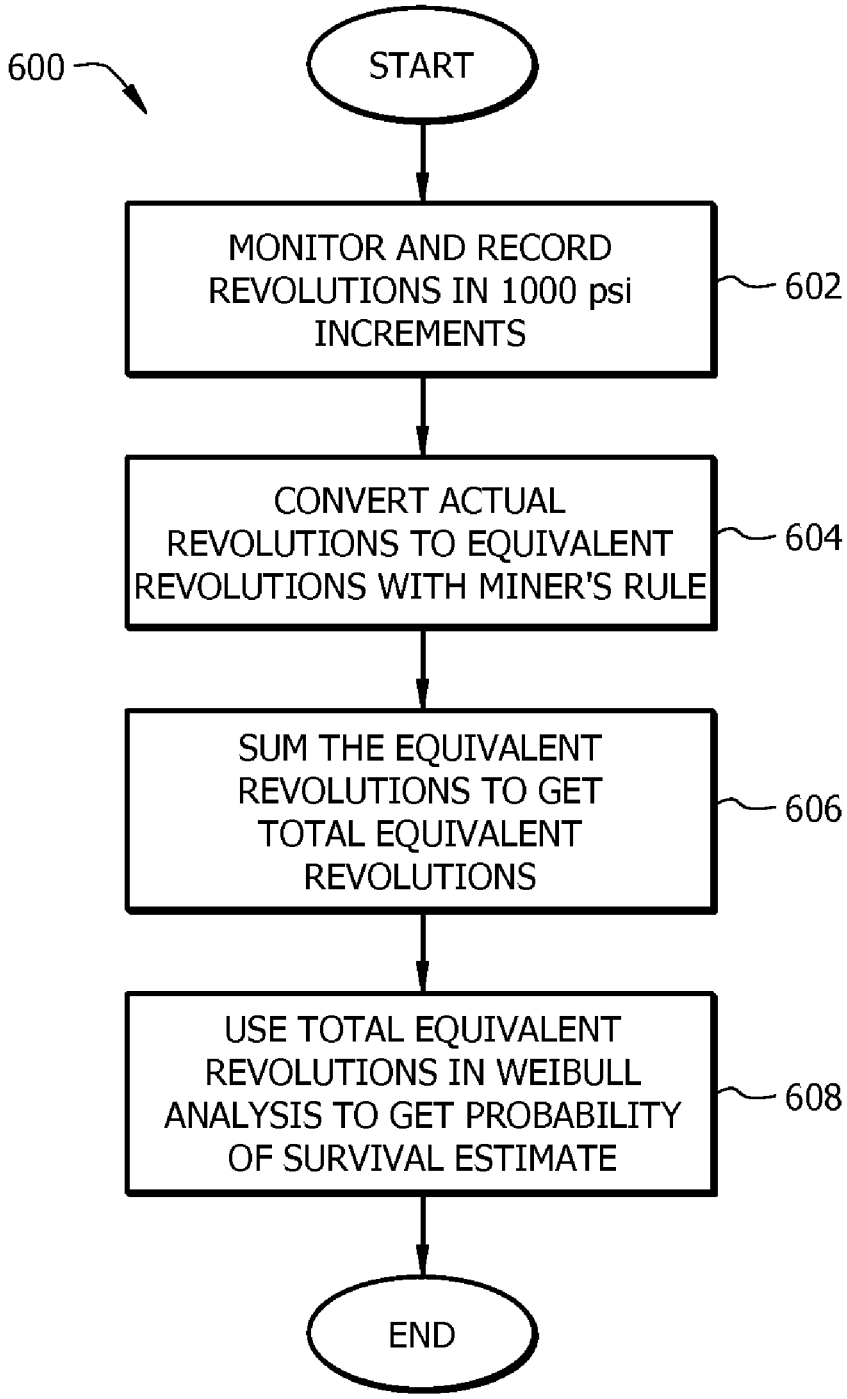
FIG. 4 is a flowchart of a method according to an embodiment.

Referring now to FIG. 4, a method 600 of operating the wellbore servicing system 100 may be used to determine a remaining life of the fluid end 504. The method 600 comprises at block 602, monitoring and recording the actual number of revolutions of the crankshaft 506 over the life of the fluid end 504. In this step, the actual revolutions are recorded and organized into pressure bands of 1000 psi increments. However, it will be appreciated that in alternative embodiments, the pressure bands may be larger or smaller, for example, the bands may be divided into increments of 10, 20, 40, 100, 200, 400, 1500, 2000, 4000, 10000, or 20000 psi increments, or any other suitable increments. Next, at block 604, the actual revolutions of each pressure band are converted to equivalent revolutions according to Miner's Rule or other life equations. Next, at block 606, the various equivalent revolutions are summed to calculate a total equivalent revolutions value. Finally, at block 608, the total equivalent revolutions value is used in a Weibull or other statistical analysis (e.g., used in a Weibull or other reliability equation) to calculate a probability of survival estimate. As previously explained with reference to FIG. 6, conditional probabilities may be calculated and used to determine the probability of successfully completing a defined wellbore servicing profile.

Figure 5:
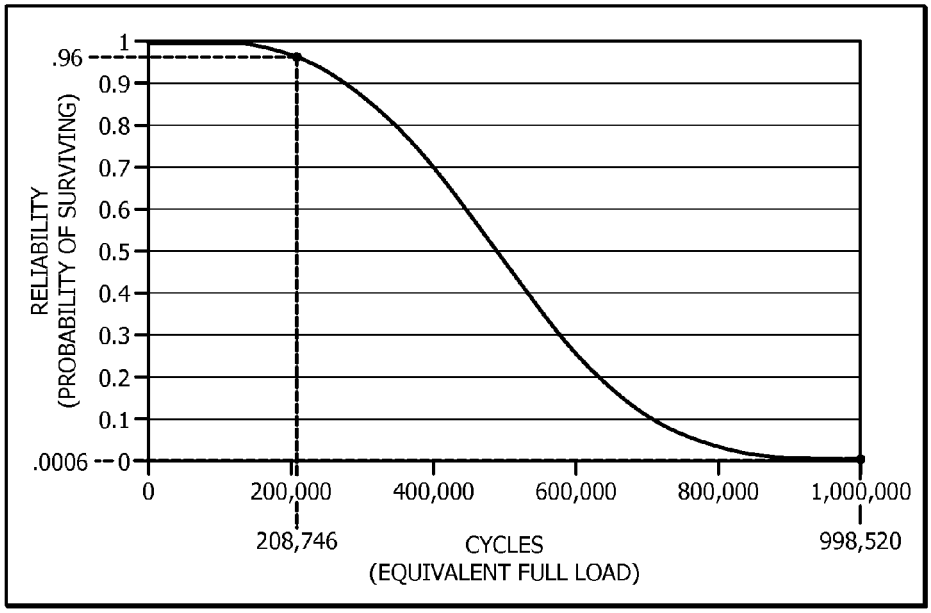
FIG. 5 is a plot showing a probability of survival estimate calculated according to the method of FIG. 4.

In an embodiment where the actual revolutions and the equivalent revolutions are shown in the respective pressure bands below, the fluid end 504 is calculated to have a probability of survival estimate of 96%, meaning that there is a 96% chance that the fluid end 504 would survive operation to the total equivalent revolutions value of 208,746 revolutions. FIG. 5 illustrates the probability of survival estimate as displayed on a Weibull analysis based reliability plot and may be used to obtain the above-mentioned probability of survival estimate of about 96%.

| Pressure Band (psi) | Actual Revolutions of Crankshaft | Equivalent Revolutions |
|---|---|---|
| 1000 | 241160 | 281 |
| 2000 | 240 | 2 |
| 3000 | 1740 | 55 |
| 4000 | 63140 | 4713 |
| 5000 | 195940 | 28567 |
| 6000 | 276160 | 69573 |
| 7000 | 139700 | 55888 |
| 8000 | 74000 | 44191 |
| 9000 | 6440 | 5476 |
| 10000 | | |
| 11000 | | |
| 12000 | | |
| 13000 | | |
| 14000 | | |
| 15000 | | |
| Total | 998520 | 208746 |

The equivalent revolutions column values were calculated according to the equation:

$$\text{Equivalent_Revolutions} = \text{actual_revolutions} * \left(\frac{\text{average_pressure}}{\text{maximum_work_pressure}}\right)^3$$

It will be appreciated that the above exponent, 3, may alternatively be replaced with a number between about 2 to about 4.5. Further, it will be appreciated that the maximum_work_pressure in this embodiment is set to the maximum working pressure of the fluid end. For this example, the maximum is 10,000 psi.

The probability of survival estimate was calculated according to the equation:

$$R(\text{total_equivalent_revolutions}) = e^{-\left(\frac{total_equivalent_revolutions}{543,408}\right)^{3.3}}$$

It will be appreciated that the values, 3.3 and 543,408, are chosen to find a best fit to standard historical fluid end 504 failures which define the failure data set of this embodiment.

Example 2

Figure 7:
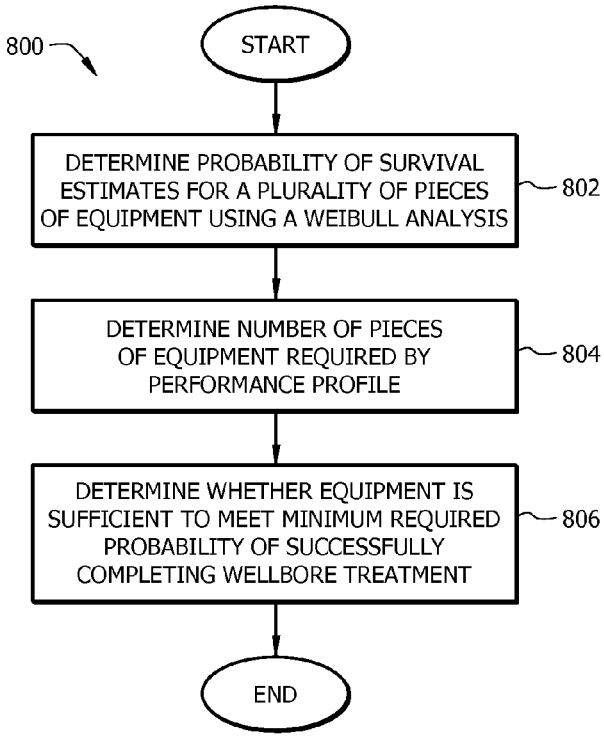
FIG. 7 is a flowchart of a method according to another embodiment.

Equipment casting for a wellbore servicing operation may be performed according to a method 800 as shown in FIG. 7. The method of equipment casting 800 begins at block 802 where a probability of survival estimate is calculated for each of a plurality of pieces of wellbore servicing equipment that are being considered for assignment to a wellbore servicing operation. The probability of survival estimate is calculated according to either one of the methods disclosed in the presentation materials (e.g., according to either a single stress variable method or according to a multiple stress variable method). Regardless of which method is utilized, calculating the probability of survival estimate of the various pieces of equipment necessarily involves the application of a Weibull analysis to determine probability of survival estimates. Next, at block 804, a total number of pieces of equipment is determined so that a performance profile is satisfied. For example, in some embodiments, a performance profile that requires a flowrate of 100 barrels per minute may be satisfied by selecting one or more pumps substantially similar to pumps 120 so that a combined flowrate capability of the pumps meets or exceeds the 100 barrels per minute requirement of the performance profile. Further, in some embodiments, selecting such equipment as necessary to meet the requirement of a performance profile may be accomplished without regard to the remaining life and/or probability of survival of the pieces of equipment. Next, at block 806, a total number of pieces of equipment is determined such that the minimum probability of completing the wellbore treatment is achieved. In other words, if the probability of survival estimates of the equipment is relatively high, then relatively less equipment may be designated. On the other hand, if the probability of survival estimates of the equipment is relatively low, then relatively more may be designated. The designation of equipment necessary to meet the minimum acceptable probability of completing the wellbore treatment may also be referred to as equipment casting as described above.

It will be appreciated that in some embodiments, the equipment may be chosen to have at least a selected combined probability of completing the wellbore treatment as designed. For example, the equipment may be restricted from having a combined probability of completing the wellbore treatment as designed of less than about 50%. However, in alternative embodiments, the equipment may instead be restricted from having a combined probability of completing the wellbore treatment as designed of less than about 10, 15, 20, 25, 30, 35, 40, 45, 55, 65, 70, 75, 85, or 90 percent, or any other selected percentage value. The above minimum percentage requirement may aid in ensuring that equipment failure is at or below a selected probability. In the inverse, the equipment may be restricted from having combined probability of completing the wellbore treatment as designed of more than about 90%. However, in alternative embodiments, the equipment may instead be restricted from having a combined probability of completing the wellbore treatment as designed of more than about 99, 98, 95, 91, 89, 85, 80, 75, 70, 65, 60, 55, 50, or 45 percent, or any other selected percentage value.

Example 3

Figure 8:
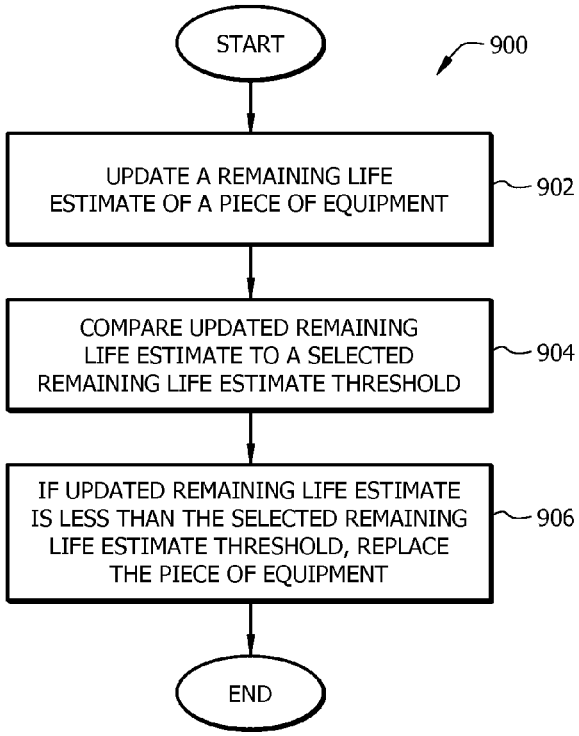
FIG. 8 is a flowchart of a method according to another embodiment.

Equipment recasting may be performed according to a method 900 as shown in FIG. 8. In this embodiment, at block 902, a remaining life estimate of a piece of equipment that is in service or otherwise in the field for use in a wellbore services operation is updated to account for use and/or operation subsequent a previous calculation of a remaining life estimate. Next, at block 904, the updated remaining life estimate is compared to a selected remaining life estimate threshold. Finally, if the updated remaining life estimate is less than the selected remaining life estimate threshold, the piece of equipment is replaced. The above procedures allow for monitoring of equipment so that when the remaining life estimate of that piece of equipment falls below a selected threshold, the piece of equipment may be decommissioned, scheduled for repair, or simply scheduled for replacement. In one embodiment, the selected remaining life threshold may be 15%. However, in other alternative embodiments, the selected remaining life threshold may be more or less than 15%, e.g., 1, 2, 5, 10, 12, 17, 20, 25, 30, 35, 40, 45, 50 percent or any other selected percentage. An alternative embodiment of a method is substantially similar to method 900, but instead of updating and comparing remaining life estimates, a probability of survival estimate is updated and compared to a selected probability of survival estimate threshold.

It will be appreciated that the above methodologies may be analogized and applied to determine a degree of wear in a centrifugal pump on a blender. Each centrifugal pump has a pressure-volume curve that shows the supposed fluid delivery of the centrifugal pump at various speeds. A table of pressure-volume curves at various pump speeds may be entered into a computer and/or controller to monitor the actual fluid delivery of the pump as compared to the supposed fluid delivery rate. When the actual fluid delivery rate falls below a selected fluid delivery threshold or percentage deviation from the pressure-volume curve, the computer and/or controller may signal that the centrifugal pump needs to be rebuilt, reconditioned, replaced, decommissioned, and/or inspected. Similarly, the hydrostatic drives for both the suction and discharge centrifugals on a blender may be monitored so that as the actual rotations per minute of the drive system as a function of the load from the centrifugal pumps no longer correlates to expected values, the hydrostatic drives may be designated to be rebuilt, reconditioned, replaced, decommissioned, and/or inspected. Further, while the disclosure illustrates primarily pieces of wellbore servicing equipment that are used for wellbore stimulation operations as benefitting from the above systems and methods, other wellbore servicing operations such as wellbore cementing operations equipment may also be cast and recast according to substantially similar principles.

Still further, it will be appreciated that in embodiments where multiple stress variables are considered in determining a remaining life estimate and/or a probability of survival estimate, the present disclosure specifically contemplates that proppant concentration and/or cumulative proppant throughput through a device may be among the multiple stress variables. By including at least one of the proppant related variables in the multiple stress variable analysis, insight may be gained into the effect of wear and/or erosion of the wellbore servicing equipment as the wear and/or erosion relates to equipment failure predictability.

Finally, it will be appreciated that the above-described systems and methods may be utilized to provide and/or calculate an overall wellbore servicing system probability of survival. As previously explained, the above methods of calculating a remaining life estimate and/or a probability of survival may be used for any piece of wellbore servicing equipment for which adequate testing and/or field collected data regarding failures of the specific piece of equipment has been acquired. Accordingly, this disclosure specifically contemplates calculating individual probabilities of survival for various pieces of wellbore servicing equipment and thereafter calculating a probability of survival for the entire group of wellbore servicing equipment. For example, a group of wellbore servicing equipment may comprise a pump having a probability of surviving of 90%, a blender having a probability of surviving of 85%, and an electrical power generator having a probability of surviving of 80%. A probability of survival for that group of wellbore servicing equipment may be calculated to equal 61.2% (90%*85%*80%).

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural or other details supplementary to the disclosure.

What is claimed is:

1. A method of servicing a wellbore, comprising:

establishing a pumping profile having a performance plan;

determining an equivalent exposure value to determine a remaining life estimate for a first wellbore servicing device, wherein the first wellbore servicing device is suitable for impacting conformance to the performance plan, and wherein the equivalent exposure value relates an exposure of the first wellbore servicing device to a stress level with a reference level of exposure at a reference stress level;

determining a probability of survival estimate using the equivalent exposure value; and selecting a second wellbore servicing device in response to the remaining life value for the first wellbore servicing device, wherein the second wellbore servicing device is suitable for impacting conformance to the performance plan.

2. The method of claim 1, wherein the second wellbore servicing device is of a different type than the first wellbore servicing device.

3. The method of claim 1, wherein the performance plan comprises a flowrate.

4. The method of claim 1, wherein the performance plan comprises a pressure.

5. The method of claim 1, wherein the equivalent exposure value is calculated as a function of a single stress variable.

6. The method of claim 1, wherein the equivalent exposure value is calculated as a function of a plurality of stress variables.

7. The method of claim 1, wherein the equivalent exposure value is calculated as a function of a pressure stress variable.

8. The method of claim 1, wherein the equivalent exposure value is calculated as a function of a flowrate stress variable.

9. The method of claim 1, wherein Miner's Rule or other life models are used to determine the equivalent exposure value.

10. The method of claim 1, wherein a Weibull or other statistical analysis is used to determine the probability of survival estimate.

11. The method of claim 1, wherein the equivalent exposure value is calculated as a function of at least one of a proppant concentration and a cumulative proppant throughput value.

12. A wellbore servicing system, comprising:

a first device suitable for impacting conformance to a performance plan;

a first sensor configured to monitor an operational characteristic of the first device; and a controller in communication with the first sensor, the controller being configured to calculate a probability of survival estimate of the first device and an equivalent exposure value, wherein the equivalent exposure value is calculated as a function of at least one of a proppant concentration or a cumulative proppant throughput value.

13. The wellbore servicing system according to claim 12, wherein the first device is a positive displacement pump.

14. The wellbore servicing system according to claim 12, further comprising:

a display for visually displaying the probability of survival estimate of the first device.

15. The wellbore servicing system according to claim 12, wherein Miner's Rule or other life models are used to determine the equivalent exposure value.

16. The wellbore servicing system according to claim 12, wherein a Weibull or other statistical analysis is used to determine the probability of survival estimate of the first device.

17. The wellbore servicing system according to claim 12, further comprising:

a second device suitable for impacting conformance to the performance plan; and a second sensor configured to monitor an operational characteristic of the second device;

wherein the controller is in communication with the second sensor and is configured to calculate at least one of a remaining life estimate of the wellbore servicing system and a probability of survival estimate of the wellbore servicing system.

18. The wellbore servicing system according to claim 17, wherein the second device is of a type different than the first device.

19. The wellbore servicing system according to claim 12, wherein the controller is further configured to calculate the probability of survival estimate of the first device based on the equivalent exposure value.

20. The wellbore servicing system according to claim 12, wherein the controller is further configured to calculate a remaining life estimate of the first device.

21. The wellbore servicing system according to claim 20, wherein the display is configured to visually display the remaining life estimate of the first device.

22. A wellbore servicing pump, comprising:

a first sensor configured to monitor an operational characteristic of the pump; and a controller in communication with the first sensor, the controller being configured to calculate a probability of survival estimate of the wellbore servicing pump based on an equivalent exposure value, wherein the equivalent exposure value relates an exposure of the first wellbore servicing device to a stress level with a reference level of exposure at a reference stress level.

23. The wellbore servicing pump according to claim 22, wherein the probability of survival estimate of the wellbore servicing pump represents a probability of the wellbore servicing pump completing a wellbore treatment in accordance to a pressure performance plan of a pumping profile.

24. The wellbore servicing pump according to claim 22, wherein the probability of survival estimate of the wellbore servicing pump represents a probability of the wellbore servicing pump completing a wellbore treatment in accordance to a fluid flowrate performance plan of a pumping profile.

25. The wellbore servicing pump according to claim 22, wherein the controller is further configured to calculate a remaining life estimate for the wellbore servicing pump, and wherein the probability of survival estimate comprises a conditional probability of survival to the end of the remaining life estimate.

* * * * *